US008434612B2

(12) United States Patent
Hugues

(10) Patent No.: US 8,434,612 B2
(45) Date of Patent: May 7, 2013

(54) POSTAL SORTING MACHINE HAVING A MAILPIECE RECIRCULATION DEVICE COMPRISING A CLEATED BELT

(75) Inventor: Damien Hugues, Bourg les Valence (FR)

(73) Assignee: Solystic, Gentilly Cedex (FR)

( * ) Notice: Subject to any disclaimer, the term of this patent is extended or adjusted under 35 U.S.C. 154(b) by 236 days.

(21) Appl. No.: 12/990,742

(22) PCT Filed: Sep. 9, 2010

(86) PCT No.: PCT/FR2010/051879
§ 371 (c)(1),
(2), (4) Date: Nov. 2, 2010

(87) PCT Pub. No.: WO2011/033212
PCT Pub. Date: Mar. 24, 2011

(65) Prior Publication Data

US 2011/0253512 A1 Oct. 20, 2011

(30) Foreign Application Priority Data

Sep. 18, 2009 (FR) ..... 09 56424

(51) Int. Cl.
*B07C 3/00* (2006.01)

(52) U.S. Cl.
USPC ..... 198/690.2; 198/818; 53/552

(58) Field of Classification Search ..... 198/690.2, 198/818; 53/539, 552, 900
See application file for complete search history.

(56) References Cited

U.S. PATENT DOCUMENTS 3,782,541 A * 1/1974 Wood ..... 209/584
4,094,123 A * 6/1978 Carlson ..... 53/436
4,795,042 A * 1/1989 Klein et al. ..... 211/186
4,832,183 A * 5/1989 Lapeyre ..... 198/699
4,934,129 A * 6/1990 Hoffman et al. ..... 53/443
5,518,122 A * 5/1996 Tilles et al. ..... 209/539
6,321,913 B1 * 11/2001 Rebel et al. ..... 209/509
6,365,862 B1 * 4/2002 Miller et al. ..... 209/584
6,811,021 B1 * 11/2004 Corley ..... 198/690.2
6,926,134 B2 * 8/2005 Verdigets et al. ..... 198/867.15
6,950,724 B2 * 9/2005 Mileaf et al. ..... 700/224
7,131,532 B2 * 11/2006 Webster et al. ..... 198/867.15
7,252,191 B2 * 8/2007 Ozaki et al. ..... 198/779
7,378,610 B2 * 5/2008 Umezawa et al. ..... 209/584
7,414,219 B2 * 8/2008 Quine et al. ..... 209/584
7,597,189 B2 * 10/2009 Hinsley et al. ..... 198/690.2
2004/0153208 A1 8/2004 Wilke

FOREIGN PATENT DOCUMENTS

FR 2704460 A1 11/1994

OTHER PUBLICATIONS

International Search Report for PCT/FR2010/051879 Dec. 30, 2010.
French Search Report Apr. 12, 2010 for FR0956424 with partial English translation.

* cited by examiner

*Primary Examiner* — Douglas Hess
(74) *Attorney, Agent, or Firm* — Sughrue Mion, PLLC

(57) ABSTRACT

The postal sorting machine has sorting outlets in which mailpieces are accumulated, said sorting outlets being disposed in line along a certain longitudinal axis. It further includes a recirculation device for recirculating the mailpieces stored in the sorting outlets, this device comprising a belt (40) mounted to move along the sorting outlets and to which cleats (41, 42) are fastened to define a succession of compartments (4*a*, 4*b*, 4*c*) that face respective ones of the sorting outlets, each compartment being arranged to store, on edge, mailpieces taken from a corresponding sorting outlet.

5 Claims, 1 Drawing Sheet

POSTAL SORTING MACHINE HAVING A MAILPIECE RECIRCULATION DEVICE COMPRISING A CLEATED BELT

The invention relates to the field of postal sorting, and in particular to a postal sorting machine having sorting outlets in which mailpieces are accumulated, said sorting outlets being disposed in line along a certain longitudinal axis.

In operation, the sorting outlets are usually emptied into removable trays that are placed below or facing the sorting outlets. The trays can then be conveyed to the inlet of the machine for another mailpiece sorting pass, or they can be brought to a packaging system downstream from the sorting process. Those operations require a great deal of handling that can cause the mailpieces to be put out of sequence. Such operations are part of what is commonly known as the "recirculation process" for recirculating the mailpieces from the sorting outlets.

An object of the invention is to propose a sorting machine arrangement in which the mailpiece recirculation process is improved.

To this end, the invention provides a postal sorting machine having sorting outlets in which mailpieces are accumulated, said sorting outlets being disposed in line along a certain longitudinal axis, said postal sorting machine being characterized in that it further includes a recirculation device for recirculating the mailpieces stored in the sorting outlets, this device comprising a belt mounted to move along the sorting outlets and to which cleats are fastened to define a succession of compartments that face respective ones of the sorting outlets, each compartment being arranged to store, on edge, mailpieces taken from a corresponding sorting outlet.

With this arrangement, the operator of the machine can transfer the contents of each sorting outlet to a corresponding compartment of the cleated belt by stowing them on edge in said compartment. Said cleats may be fastened to the belt by means of screws, for example, so as to be easy to remove and to replace. The compartments filled with mailpieces are brought automatically either to the inlet of the machine, or, for example, to a packaging system downstream from the sorting process, by causing the cleated belt to move.

In order to hold a stack of mailpieces on edge in a compartment, it is possible, advantageously, to provide each compartment with a paddle, the position of which paddle is adjustable. For example, said paddle may be a removable plate held between two cleats forming the two sides of the compartment, the distance between the paddle and the back of the compartment being adjusted to fit the size of the stack of mailpieces. The fastening mode whereby the paddle is fastened between two side cleats may be of the peg-and-hole type or of the tongue-and-groove type. It can be understood that each cleat is provided with a succession of paddle-fastening means distributed over the depth of the compartment so as to enable the position of the paddle to be adjusted as a function of the size of the stack of mailpieces to be stored on edge in the compartment. In order to transfer mailpieces on edge from a sorting outlet to a compartment, the operator can start by positioning the paddle of the compartment in a configuration corresponding to a maximum storage volume. Then the operator places the mailpieces on edge at the back of the compartment, and then adjusts the position of the paddle so that it presses the mailpieces against the back of the compartment. If this process of transferring mailpieces and of adjusting the position of the paddle is performed automatically by equipment such as a robotic arm, it is possible to provide pressure sensors, for example, on the back wall of the compartment or on the paddle so as to servo-control the adjustment of the positioning of the paddle in the compartment.

The machine of the invention is described below in more detail.

FIG. 1 is a highly diagrammatic view of a postal sorting machine 1 for sorting flat mailpieces that has an unstacking inlet 2 and sorting outlets, in each of which the sorted mailpieces are accumulated and stored on edge in a stack.

Figure 1:
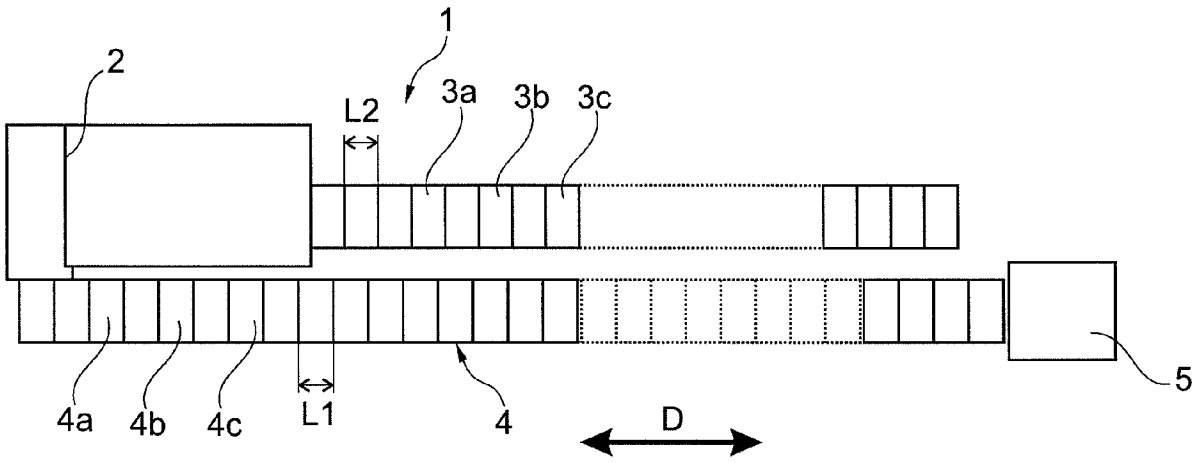
FIG. 1 is a diagram showing a postal sorting machine with a recirculation device in the form of a cleated belt, for recirculating flat mailpieces.

In FIG. 1, only three sorting outlets such as 3*a*, 3*b*, 3*c* are referenced, but naturally a postal machine may have several tens of such sorting outlets of the type having joggers, and, for example, lined up in one or more rows (superposed or juxtaposed heightwise) along a certain longitudinal axis D.

FIG. 1 also shows a recirculation device for recirculating the mailpieces from the sorting outlets to the inlet 2 of the machine or to a mailpiece packaging system 5. This device comprises a motor-driven belt 4 provided with cleats forming compartments, such as 4*a*, 4*b*, 4*c*. The cleated belt is suitable for moving along the axis D along the sorting outlets, in one direction and/or in the other.

Figure 2:
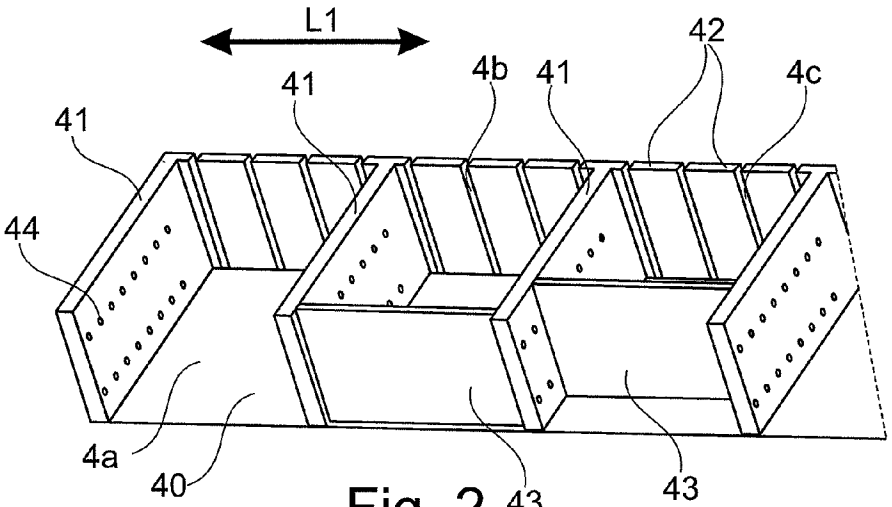
FIG. 2 is a diagrammatic perspective view of a portion of the cleated belt.

FIG. 2 shows this cleated belt in more detail. Said cleated belt thus comprises a flat belt or strip 40 on which cleats 41 are disposed that define the compartments such as 4*a*, 4*b*, or 4*c*. Each compartment therefore has two sides, each of which is formed by a respective cleat 41 disposed perpendicularly to the belt 40 and fastened, e.g. removably, thereto by screws or the like. The back of the compartment is also formed of removable vertical cleats 42 that define a sort of raised edge along one longitudinal side of the belt 40. It can be seen in FIG. 2 that these cleats 42 are in the form of disjoint slats that are disposed in mutually adjacent manner so as to enable the belt to follow a closed-loop path. FIG. 2 also shows a removable paddle 43 in the form of a plate disposed between two side cleats 41 of a compartment. It is also shown that the side cleats 41 are provided with a fastening system 44 of the peg-and-hole type for fastening the paddle (see the two rows of holes visible on the right face of each of the side cleats). With this fastening system, it is possible to adjust the depth of storage of the mailpieces in a compartment so as to hold said mailpieces properly in a stack, on edge, while the cleated belt is moving along the axis D. It should be understood that the positions of the paddles 43 of the compartments may be adjusted differently depending on the compartment, so as to accommodate the different volumes of mailpieces stored in the sorting outlets at the time at which the mailpieces are transferred from the outlets to the compartments. The cleats 41 and 42 may, for example, be made of a fairly rigid plastics material, whereas the belt may be made of rubber or of a plastics material.

As indicated above, this transfer may take place automatically, e.g. by means of a robotic arm suitable for positioning the paddle of each compartment correctly as a function of the volume of mailpieces to be stored.

Generally, the cleated belt defines at least as many compartments as there are sorting outlets to serve in the machine. More particularly, each of the compartments preferably has a width L1 along the axis D of about 350 millimeters (mm) that is equivalent to the width L2 of the sorting outlets in a manner such that the outlets and the compartments are aligned relative to one another, as shown in FIG. 1. The width of the belt 40 may be about 400 mm (as measured perpendicularly to the axis D).

It is also possible to make provision to use the paddles 43 as mailpiece separators by circulating the separators in the sorting machine between the unstacking inlet and the sorting outlets. More particularly, a paddle 43 is a plate (that is not too rigid) that can receive marking indicative of a sorting outlet that is machine-readable, e.g. a bar code, analogous to the bar code that is put on a separator. In accordance with the invention, at the end of a sorting process preceding a transfer of mail from the sorting outlets to the compartments, it is possible to make provision to bring to the unstacking inlet of the sorting machine a set of such paddles 43 (the number of such paddles being sufficient for them to be distributed over all of the sorting outlets of the machine). Each paddle 43 is thus moved like a separator from the unstacking inlet of the sorting machine to a sorting outlet in which mailpieces are accumulated in a stack. The operator or an articulated robot arm then merely needs to take hold of said stack of mailpieces together with the paddle 43, and to place the resulting set at the back of a compartment of the cleated belt (which compartment corresponds to said outlet), while fastening the paddle between the two sides of the compartment. It can be understood that this arrangement can simplify the handling of the mailpieces for the purposes of transferring them to the compartments.

This mailpiece recirculation system of the invention thus makes it possible to avoid using removable storage trays. It is particularly well suited for postal sorting machines used for sorting small mailpieces, of the C5 format or of the C4 format, for example.

The invention claimed is:

1. A postal sorting machine having an inlet (2) and sorting outlets (3*a*, 3*b*, 3*c*) in which mailpieces are accumulated after being circulated from said inlet (2), said sorting outlets being disposed in line along a certain longitudinal axis (D), said postal sorting machine being characterized in that it further includes a recirculation device (4) for recirculating the mailpieces stored in the sorting outlets to said inlet (2), this device comprising a belt (40) mounted to move along said longitudinal axis (D) and along the sorting outlets up to said inlet (2) and to which cleats (41, 42) are fastened to define a succession of compartments (4*a*, 4*b*, 4*c*), each compartment (4*a*, 4*b*, 4*c*) having a width along said longitudinal axis (D) equivalent to the width along said longitudinal axis (D) of said sorting outlets so that said compartments (4*a*, 4*b*, 4*c*) simultaneously face respective ones of the sorting outlets, each compartment being arranged to store, on edge, mailpieces taken from a corresponding sorting outlet.

2. The machine according to claim 1, wherein each compartment is provided with a paddle (43), the position of which paddle is adjustable to hold in position and on edge a stack of articles stored in the compartment.

3. The machine according to claim 2, wherein the paddle (43) is a removable plate held between two cleats forming the two sides of the compartment.

4. The machine according to claim 3, wherein the cleats are screw-fastened to the belt.

5. The machine according to claim 3, wherein the compartment paddles (43) are also arranged to be passed through the sorting machine as separators.

* * * * *